US011413868B2

(12) United States Patent
Katayama et al.

(10) Patent No.: US 11,413,868 B2
(45) Date of Patent: Aug. 16, 2022

(54) LIQUID DISCHARGE HEAD

(71) Applicant: Brother Kogyo Kabushiki Kaisha, Nagoya (JP)

(72) Inventors: Hiroshi Katayama, Toyoake (JP); Shohei Koide, Nagoya (JP); Keita Sugiura, Toyokawa (JP); Keita Hirai, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 7 days.

(21) Appl. No.: 16/878,101

(22) Filed: May 19, 2020

(65) Prior Publication Data

US 2020/0384771 A1 Dec. 10, 2020

(30) Foreign Application Priority Data

Jun. 6, 2019 (JP) ..... JP2019-106104

(51) Int. Cl.
*B41J 2/14* (2006.01)

(52) U.S. Cl.
CPC .. *B41J 2/14233* (2013.01); *B41J 2002/14306* (2013.01)

(58) Field of Classification Search
None
See application file for complete search history.

(56) References Cited

U.S. PATENT DOCUMENTS

2017/0253037 A1 9/2017 Kobayashi
2019/0299619 A1* 10/2019 Katayama ..... B41J 2/175

FOREIGN PATENT DOCUMENTS

WO 2016-031920 A1 3/2016

* cited by examiner

*Primary Examiner* — Erica S Lin
(74) *Attorney, Agent, or Firm* — Banner & Witcoff, Ltd.

(57) ABSTRACT

There is provided a liquid discharge head including a channel unit including: individual channels aligned in a first direction, and first and second common channels extending in the first direction. Each of the individual channels includes: a nozzle, a pressure chamber, and first and second communicating channels. The channel unit further includes a linking channel linking two pieces of the second communicating channel to each other. Resistance, in one of the two individual channels, from one end of the second communicating channel up to a linking part of the second communicating channel at which the second communicating channel is linked to the linking channel is different from resistance, in the other of the two individual channels, from the one end of the second communicating channel up to the linking part of the second communicating channel.

11 Claims, 6 Drawing Sheets

LIQUID DISCHARGE HEAD

CROSS REFERENCE TO RELATED APPLICATION

The present application claims priority from Japanese Patent Application No. 2019-106104, filed on Jun. 6, 2019, the disclosure of which is incorporated herein by reference in its entirety.

BACKGROUND

Field of the Invention

The present disclosure relates to a liquid discharge head provided with a plurality of individual channels and a common channel.

Description of the Related Art

Conventionally, there is a publicly known liquid discharge head provided with a plurality of discharge units (individual channels), a secondary supply channel commonly connected with respect to individual supply channels of the plurality of discharge units, respectively, and a secondary recovery channel commonly connected with respect to individual recovery channels of the plurality of discharge units, respectively. Further, there is a publicly known liquid discharge head wherein individual recovery channels, included in two discharge units, among the plurality of discharge units, are linked to each other by a linking channel.

SUMMARY

In the publicly known liquid discharge head as described above, a distance from one end, of the individual recovery channel, communicating with a pressure applying chamber up to a linking part, of the individual recovery channel, at which the individual recovery channel is linked to the linking channel in one of the two discharge units and a distance from the one end up to the linking part of the individual recovery channel in the other of the two discharge units are same as each other. In this case, the resistance from the one end up to the linking part of the individual recovery channel in one of the two discharge units, and the resistance from the one end up to the linking part of the individual recovery channel in the other of the two discharge units might be same as each other. In this case, if the difference in pressure between the both ends in the linking channel became to be 0 (zero), any flow of the liquid does not occur in the linking channel Thus, such a problem might occur that discharge of the air in the inside of the liking channel and/or agitation of any sedimentary component in a liquid in the inside of the linking channel cannot be realized.

An object of the present disclosure is to provide a liquid discharge head capable of causing a flow of the liquid in the inside of the linking channel, and of realizing the discharge of the air in the inside of the linking channel and/or the agitation of any sedimentary component in the inside of the linking channel.

According to an aspect of the present disclosure, there is provided a liquid discharge head including a channel unit. The channel unit includes: a first common channel extending in a first direction; a second common channel extending in the first direction; a plurality of individual channels aligned in the first direction, and a linking channel Each of the plurality of individual channels includes: a nozzle; a pressure chamber communicating with the nozzle; a first communicating channel having one end communicating with the pressure chamber and the other end communicating with the first common channel; and a second communicating channel having one end communicating with the pressure chamber and the other end communicating with the second common channel. The linking channel links two pieces of the second communicating channel to each other. The two of the second communicating channel are included in two individual channels among the plurality of individual channels. Resistance, in one of the two individual channels, from the one end of the second communicating channel up to a linking part of the second communicating channel at which the second communicating channel is linked to the linking channel is different from resistance, in the other of the two individual channels, from the one end up to the linking part of the second communicating channel.

DESCRIPTION OF THE EMBODIMENTS

First Embodiment

Figure 1:
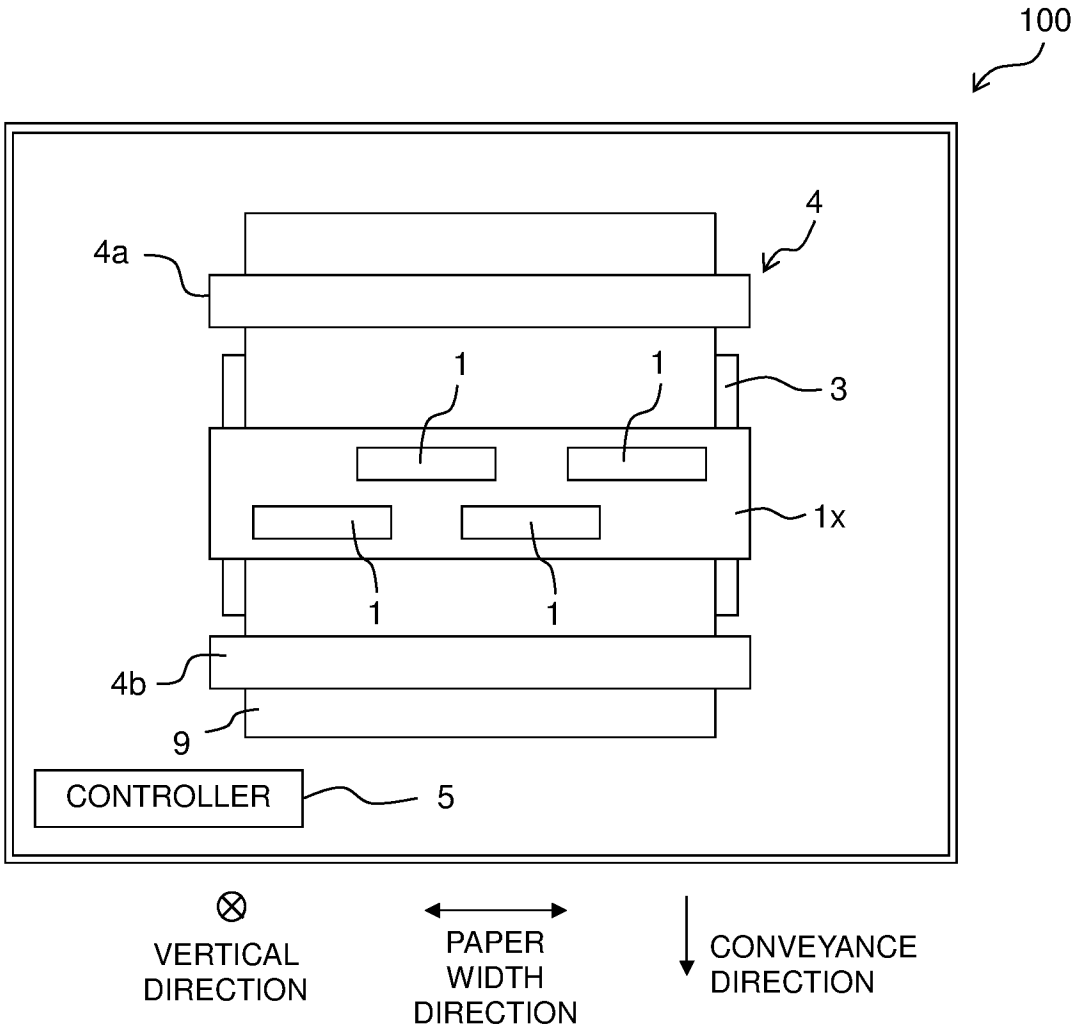
FIG. 1 is a plan view of a printer 100 provided with a head 1.

Firstly, the overall configuration of a printer 100 provided with a head 1 according to a first embodiment will be explained, with reference to FIG. 1.

The printer 100 is provided with a head unit 1*x* including four heads 1, a platen 3, a conveyor 4 and a controller 5.

A paper sheet (sheet, paper) 9 is placed on the upper surface of the platen 3.

The conveyor 4 has a pair of rollers 4*a* and a pair of rollers 4*b* which are arranged with the platen 3 intervened therebetween in a conveyance direction. In a case that a conveying motor (of which illustration is omitted in the drawings) is driven by control of the controller 5, the roller pairs 4*a* and 4*b* rotate in a state that the paper sheet 9 is sandwiched or pinched therebetween, thereby conveying the paper sheet 9 in the conveying direction.

The head unit 1*x* is elongated in a paper width direction (direction orthogonal to both of the conveyance direction and the vertical direction), and discharges an ink with respect to the paper sheet 9 from nozzles 21 (see FIGS. 2 and 3) in a state that the position of the head unit 1*x* is fixed. The head 1 is an ink-jet head of the so-called line system. The four heads 1 are each elongated in the paper width direction, and are arranged in a staggered manner in the paper width direction.

The controller 5 has a ROM (Read Only Memory), a RAM (Random Access Memory) and an ASIC (Application Specific Integrated Circuit). The ASIC executes a recording processing, etc., in accordance with a program stored in the ROM. In the recording processing, the controller 5 controls a driver IC of each of the heads 1 and the conveyance motor (both of which are omitted in the illustration of the drawings), based on a recording instruction or recording command (including image data) inputted from an external apparatus or external device such as a PC, and performs recording of an image, etc., on the paper sheet 9.

Next, the configuration of the head 1 will be explained with reference to FIGS. 2 and 3.

Figure 3:
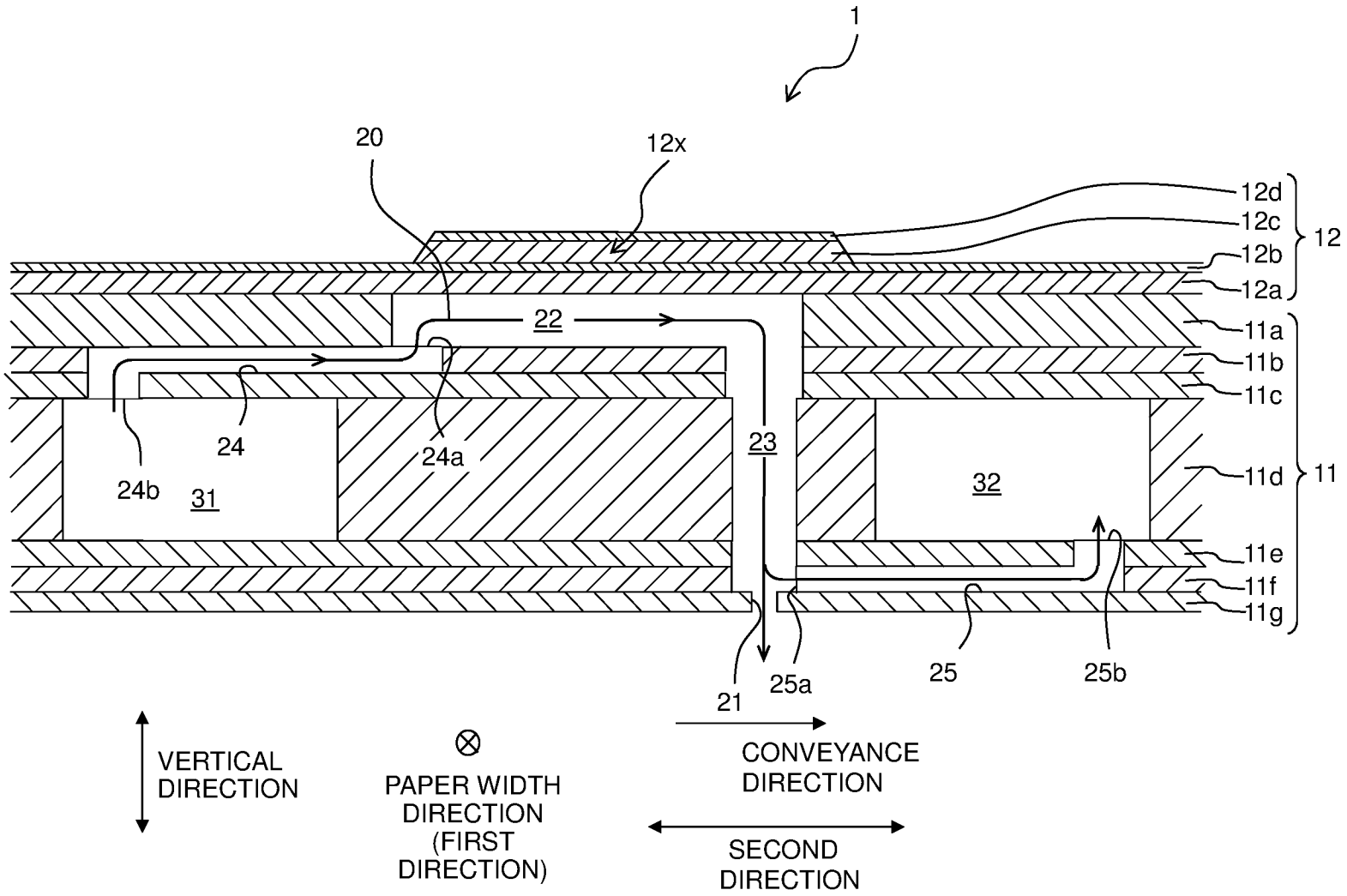
FIG. 3 is a cross-sectional view of the head 1, taken along a line III-III in FIG. 2.

As depicted in FIG. 3, the head 1 has a channel substrate 11 and an actuator substrate 12.

The channel substrate 11 is constructed of 7 (seven) plates 11*a* to 11*g* which are stacked in the vertical direction and adhered to one another. Each of the plates 11*a* to 11*g* has a through hole formed therein and constructing a channel. The channel includes a plurality of individual channels 20, a supply channel 31 and a return channel 32.

Figure 2:
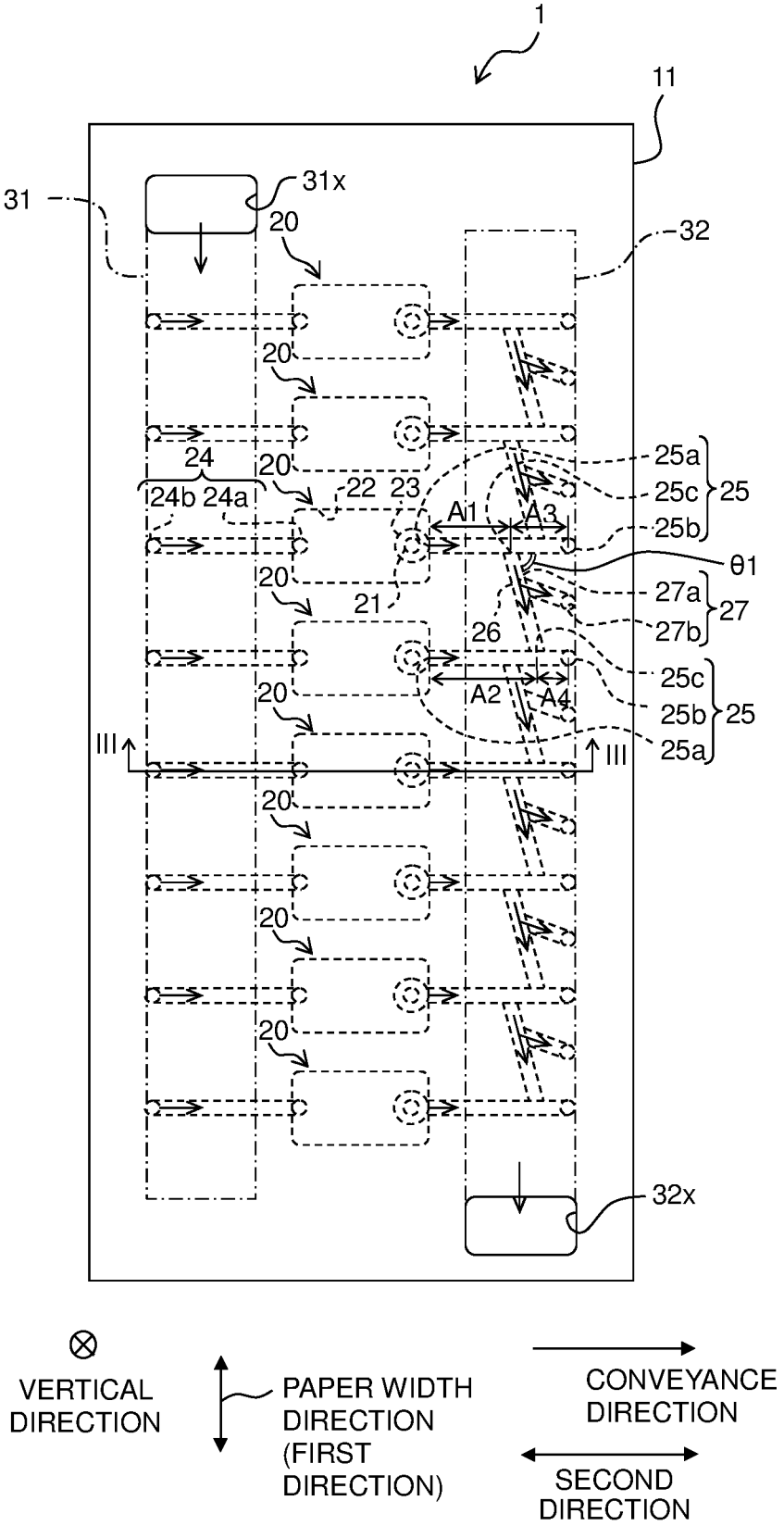
FIG. 2 is a plan view of the head 1.

As depicted in FIG. 2, the plurality of individual channels 20 are arranged in a row (array) in the paper width direction (first direction). Each of the plurality of individual channels 20 includes a nozzle 21, a pressure chamber 22, a connecting channel 23, an inflow channel 24 and an outflow channel 25.

As depicted in FIG. 3, the nozzle 21 is constructed of a through hole formed in the plate 11*g*, and is open in the lower surface of the channel substrate 11.

As depicted in FIG. 3, the pressure chamber 22 is formed of a through hole formed in the plate 11*a*, and is open in the upper surface of the plate 11*a*. As depicted in FIG. 2, the pressure chamber 22 has a substantially rectangular shape which is elongated in a direction parallel to the conveyance direction. With respect to the pressure chamber 22, the inflow channel 24*a* is connected to one end in the second direction of the pressure chamber 22, and the connecting channel 23 is connected to the other end in the second direction of the pressure chamber 22. The direction parallel to the conveyance direction (second direction) is a width direction of each of the supply channel 31 and the return channel 32, and a direction crossing the first direction. The pressure chamber 22 communicates with the nozzle 21 via the connecting channel 23.

As depicted in FIG. 3, the connecting channel 23 is constructed of through holes formed in the plates 11*b* to 11*f*, respectively, and extends in the vertical direction. The connecting channel 23 is arranged between the nozzle 21 and the pressure chamber 22 in the vertical direction, and connects the nozzle 21 and the pressure chamber 22 to each other.

As depicted in FIG. 3, the inflow channel 24 is constructed of through holes formed in the plates 11*b* and 11*c*, respectively. The inflow channel 24 has one end 24*a* communicating with the pressure chamber 22 and other end 24*b* communicating with the supply channel 31.

As depicted in FIG. 3, the outflow channel 25 is constructed of through holes formed in the plates 11*e* and 11*f*, respectively. The outflow channel 25 has one end 25*a* communicating with the connecting channel 23 and the other end 25*b* communicating with the return channel 32.

As depicted in FIG. 2, each of the inflow channel 24 and the outflow channel 25 extends in the second direction. A width (length in the first direction) of each of the inflow channel 24 and the outflow channel 25 is smaller than a width (length in the first direction) of the pressure chamber 22, and functions as a throttle.

As depicted in FIG. 3, the actuator substrate 12 includes, in an order from the lower side thereof, a vibration plate 12*a*, a common electrode 12*b*, a plurality of piezoelectric bodies 12*c* and a plurality of individual electrodes 12*d*.

The vibration plate 12*a* and the common electrode 12*b* are arranged on the upper surface of the channel substrate 11, and cover all the pressure chambers 22 formed in the plate 11*a*. On the other hand, each of the plurality of piezoelectric bodies 12*c* and each of the plurality of individual electrodes 12*d* are provided with respect to one of the pressure chambers 22, and overlap with one of the pressure chambers 22 in the vertical direction.

The common electrode 12*b* and the plurality of individual electrodes 12*d* are electrically connected to a driver IC (omitted in the drawings). The driver IC maintains the potential of the common electrode 12*b* at the ground potential, whereas changes the potential of each of the plurality of individual electrodes 12*d*. Specifically, the driver IC generates a driving signal based on a control signal from the controller 5, and applies the driving signal to each of the plurality of individual electrodes 12*d*. With this, the potential of each of the plurality of individual electrodes 12*d* is changed between a predetermined driving potential and the ground potential. In this situation, parts or portions in the vibration plate 12*a* and one of the plurality of piezoelectric bodies 12*c*, respectively, which are sandwiched between each of the plurality of individual electrodes 12*d* and one of the pressure chambers 22 corresponding thereto (actuator 12*x*) are deformed so as to project toward one of the pressure chambers 22, thereby changing the volume of one of the pressure chambers 22, applying the pressure to the ink inside one of the pressure chamber 22, and causing the ink to be discharged from the nozzle 21 corresponding to one of the pressure chambers 22. The actuator substrate 12 has a plurality of pieces of the actuator 12*x* corresponding to the pressure chambers 22, respectively.

As depicted in FIG. 2, Each of the supply channel 31 and the return channel 32 extends in the first direction, and the supply channel 31 and the return channel 32 are arranged side by side in the second direction while sandwiching the pressure chambers 20 of the plurality of individual channels 20 therebetween. As depicted in FIG. 3, the supply channel 31 and the return channel 32 have lengths (lengths in the first direction), widths (lengths in the second direction) and heights (lengths in the vertical direction) which are substantially same, respectively, to each other.

The supply channel 31 communicates with a sub tank (omitted in the drawings) via a supply port 31*x* provided on one end thereof in the first direction (upper end thereof in FIG. 2). The return channel 32 communicates with the sub tank via a return port 32*x* provided on the other end thereof in the first direction (lower end thereof in FIG. 2).

The sub tank communicates with a main tank storing the ink, and stores the ink supplied from the main tank thereto. In a case that the ink is circulated between the sub tank and the channel substrate 11 (in a case that the ink is circulated, during the ink circulation), a pump (omitted in the drawings) is driven by control performed by the controller 5, thereby causing the ink inside the sub tank to flow into the supply channel 31 from the supply port 31*x*. The ink inflowed into the supply channel 31 is supplied to each of the plurality of individual channels 20 while moving inside the supply channel 31 from the one end in the first direction (upper end in FIG. 2) toward the other end in the first direction (lower end in FIG. 2). The ink outflowed from each of the plurality of individual channels 20 inflows into the return channel 32, and moves inside the return channel 32 from the one end in the first direction (upper end in FIG. 2) toward the other end in the first direction (lower end in FIG. 2), and is returned to the sub tank via the return port 32*x*.

In such a manner, the ink is circulated between the sub tank and the channel substrate 11, thereby realizing discharge of air and prevention of increase in the viscosity of the ink in the supply channel 31 and the return channel 32, and further in each of the individual channels 20, which are formed in the channel substrate 11. Further, in such a case that the ink contains a sedimentary component (a component which might sediment or settle; a pigment, etc.), such a sediment component is agitated, which in turn prevents any sedimentation thereof from occurring.

Here, the supply channel 31 corresponds to a "first common channel" of the present disclosure, and the return channel 32 corresponds to a "second common channel" of the present disclosure. The inflow channel 24 corresponds to a "first communicating channel" of the present disclosure, and the outflow channel 25 corresponds to a "second communicating channel" of the present disclosure. The outflow channels 25 of the respective individual channels 20 have channel area which are same as each other, and lengths in the second direction which are same as each other. Note that in the following explanation, the terms "upstream side" and "downstream side" indicate the "upstream side" and "downstream side" in a direction of flow of the ink during the ink circulation.

In the present embodiment, as depicted in FIG. 2, the channel substrate 11 is provide with linking channels 26 each of which links two outflow channels 25, of two individual channels 20 included in the plurality of individual channels 20 and adjacent to each other in the first direction (hereinafter simply referred to as "two individual channels 20"), to each other; and connecting channels 27 each of which connects one of the linking channels 26 and the return channel 32 to each other.

The linking channels 26 are provided in areas, respectively, which are located, in the first direction, between the outflow channels 25 of the plurality of individual channels 20. The connecting channels 27 are provided with respect to the linking channels 26, respectively. The linking channels 26 and the connecting channels 27 are provided on a same height as the outflow channel 25 (at a location below the return channel 32).

Each of the linking channels 26 extends in an oblique direction (a direction which is orthogonal to the vertical direction, and which crosses both of the first and second directions). Specifically, each of the linking channels 26 extends so as to be away farther from the pressure chamber 22 toward the downstream side (the lower side in FIG. 2) in the return channel 32. An angle θ1 defined between the linking channel 26 and an outflow channel 25 which is included in the two outflow channels 25, of the two individual channels 20, linked to each other by each of the linking channel 26, and which is located on the upstream side in the return channel 32, is less than 80 degrees.

In the two individual channels 20, the positions of linking parts 25*c*, at which the two outflow channels 25 in the two individual channels 20 are linked to the linking part 26, respectively, are mutually different in the second direction. Specifically, among the two individual channels 20, the linking part 25*c* in the individual channel 20 located on the upstream side in the return channel 32 (the upper side in FIG. 2) is located closer in the second direction to the pressure chamber 22 than the linking part 25*c* in the individual channel 20 located on the downstream side in the return channel 32 (the lower side in FIG. 2).

Among the two individual channels 20, a length A1 in the second direction from the one end 25*a* of the outflow channel 25 up to the linking part 25*c* of the outflow channel 25 in the individual channel 20 located on the upstream side in the return channel 32 (the upper side in FIG. 2) is shorter than a length A2 in the second direction from the one end 25*a* up to the linking part 25*c* of the outflow channel 25 in the individual channel 20 located on the downstream side (the lower side in FIG. 2) (A1<A2). Among the two individual channels 20, a length A3 in the second direction from the linking part 25*c* up to the other end 25*b* of the outflow channel 25 in the individual channel 20 located on the upstream side in the return channel 32 (the upper side in FIG. 2) is longer than a length A4 in the second direction from the linking part 25*c* up to the other end 25*b* of the outflow channel 25 in the individual channel 20 located on the downstream side (the lower side in FIG. 2) (A3>A4).

In the two individual channels 20, owing to such a positional relationship regarding the linking parts 25*c*, the resistance from one end 25*a* up to the linking part 25*c* of the outflow channel 25 (the resistance in a part corresponding to the length A1) in the individual channel 20 located on the upstream side in the return channel 32 and the resistance from the one end 25*a* up to the linking part 25*c* of the outflow channel (the resistance in a part corresponding to the length A2) in the individual channel 20 located on the downstream side in the return channel 32 are different from each other. The resistance in the part corresponding to the length A1 is smaller than the resistance in the part corresponding to the length A2. This difference in the resistance can be made to be not less than 800 kPa/(cc/sec). The difference in the resistance can be derived by setting an amount which is considered to be suitable for exhausting the air and/or agitating any sedimentary component (for example, 75 nl/sec), as a flow rate Q in the inside of the linking channel 26, from the relationship of pressure P/flow rate Q.

Further, in the two individual channels 20, the resistance from the linking part 25*c* up to the other end 25*b* of the outflow channel 25 (the resistance in a part corresponding to the length A3) in the individual channel 20 located on the upstream side in the return channel 32 and the resistance from the linking part 25*c* up to the other end 25*b* of the outflow channel 25 (the resistance in a part corresponding to the length A4) in the individual channel 20 located on the downstream side in the return channel 32 are different from each other. The resistance in the part corresponding to the length A3 is greater than the resistance in the part corresponding to the length A4.

The linking channel 26 links to a part, in each of the outflow channels 25, which is located between the center in the second direction and the other end 25*b* in the second direction. In each of the two individual channels 20, the length A1, A2 from the one end 25*a* up to the linking part 25*c* of the outflow channel 25 is greater than the length A3, A4 from the linking part 25*c* up to the other end 25*b* of the outflow channel 25 (A1>A3, A2>A4).

For example, it is allowable that A1=300 μm, A3=200 μm, A2=400 μm, and A4=100 μm.

The connecting channel 27 has one end 27*a* at which the connecting channel 27 connects to the linking channel 26, and the other end 27*b* at which the connecting channel 27 connects to the return channel 32. The connecting channel 27 extends in the oblique direction (direction orthogonal to the vertical direction and crossing both of the first and second directions). An extending direction of the connecting channel 27 crosses the extending direction of the linking channel 26. A direction from the one end 27*a* toward the other end 27*b* of the connecting channel 27 includes a vector (a component in a direction) toward the downstream side in the return channel 32 (the lower side in FIG. 2), and a vector (a component in a direction) from the pressure chamber 22 toward the return channel 32 (the right side in FIG. 2).

The connecting channel 27 has a length (channel length) smaller than that of the linking channel 26, and a resistance smaller than that in the linking channel 26.

In the following, an explanation will be given about a flow of the ink in a case of circulating the ink and a flow of the ink in a case of performing a purge (an operation of supplying the ink from both of the supply channel 31 and the return channel 32 to each of the plurality of individual channels 20 so as to forcibly discharge the ink from the nozzle 21).

In the case of circulating the ink, the ink supplied from the supply channel 31 to each of the plurality of individual channels 20 passes through the inflow channel 24 and inflows into the pressure chamber 22, moves substantially horizontally in the inside of the pressure chamber 22, and then inflows into the connecting channel 23. The ink inflowed into the connecting channel 23 moves downward; a part or portion of the ink is discharged from the nozzle 21, and the remaining part of the ink inflows into the outflow channel 25, as depicted in FIGS. 2 and 3.

Among the two individual channels 20, in the individual channel 20 located on the upstream side in the return channel 32 (the upper side in FIG. 2), a part of the ink inflowed into the one end 25*a* of the outflow channel 25 inflows into the linking channel 26 from the linking part 25*c*, and the remainder of the ink arrives at the other end 25*b* and inflows into the return channel 32. The ink inflowed into the linking channel 26 flows in the inside of the linking channel 26 in the oblique direction toward the downstream side in the return channel 32 (the lower side in FIG. 2). A part of this ink inflows into the connecting channel 27 and the remainder of this ink inflows into the outflow channel 25 of the individual channel 20 located on the downstream side in the return channel 32 (the lower side in FIG. 2). The ink inflowed into the connecting channel 27 flows in the inside of the connecting channel 27 in the oblique direction toward the downstream side in the return channel 32 (the lower side in FIG. 2), and inflows into the return channel 32.

Among the two individual channels 20, in the individual channel 20 located on the downstream side in the return channel 32 (the lower side in FIG. 2), the ink inflowed into the one end 25*a* of the outflow channel 25 flows from the one end 25*a* toward the other end 25*b*, joins with the ink inflowed from the linking part 25*c*, reaches the other end 25*b*, and inflows into the return channel 32.

In the case that the purge is performed, the pump (omitted in the drawings) is driven by control performed by the controller 5, thereby causing the ink inside the sub tank to flow into the supply channel 31 from the supply port 31*x*, and to flow from the return port 32*x* into the return channel 32.

In the case of performing the purge, the ink inflowed into the supply channel 31 is supplied to each of the plurality of individual channels 20, while flowing in the inside of the supply channel 31 from the one end in the first direction (upper end in FIG. 2) toward the other end in the first direction (the lower end in FIG. 2), in a similar manner as that in the case of circulating the ink. The ink supplied to each of the plurality of individual channels 20 passes through the inflow channel 24 and inflows into the pressure chamber 22, moves substantially horizontally in the inside of the pressure chamber 22, and then inflows into the connecting channel 23. The ink inflowed into the connecting channel 23 moves downward; all of the ink is discharged from the nozzle 21, without flowing into the outflow channel 25.

In the case of performing the purge, the ink inflowed into the return channel 32 moves from the other end (lower end in FIG. 2) toward the one end (upper end in FIG. 2) in the first direction in the inside of the return channel 32, in a reverse manner of that in the case of circulating the ink. This ink inflows into each of the other end 25*b* of the outflow channel 25 and the other end 27*b* of the connecting channel 27 of one of the plurality of individual channels 20.

Among the two individual channels 20, in the individual channel 20 located on the downstream side in the return channel 32 (the downstream side in the flow direction during the ink circulation, the lower side in FIG. 2), a part of the ink inflowed into the other end 25*b* of the outflow channel 25 flows into the linking channel 26 from the linking part 25*c*, and the remainder of the ink arrives at the one end 25*a* and inflows into the connecting channel 23. The ink inflowed into the connecting channel 23 is discharged from the nozzle 21.

The ink inflowed into the other end 27*b* of the connecting channel 27 flows in the inside of the connecting channel 27 in the oblique direction, arrives at the one end 27*a*, and inflows into the linking channel 26. This ink joins with the ink inflowed into the linking channel 26 from the outflow channel 25 of the individual channel 20 located on the downstream side in the return channel 32 (the downstream side in the flow direction during the ink circulation, the lower side in FIG. 2), and inflows into the outflow channel 25 of the individual channel 20 located on the upstream side in the return channel 32 (the upstream side in the flow direction during the ink circulation, the upper side in FIG. 2).

Among the two individual channels 20, in the individual channel 20 located on the upstream side in the return channel 32 (the upstream side in the flow direction during the ink circulation, the upper side in FIG. 2), the ink inflowed into the other end 25*b* of the outflow channel 25 flows from the other end 25*b* toward the one end 25*a*, and joins with the ink inflowed from the linking part 25*c*, arrives to the one end 25*a*, and inflows into the connecting channel 23. The ink inflowed into the connecting channel 23 is discharged from the nozzle 21.

As described above, according to the present embodiment, the linking part 26 linking the outflow channels 25 of the two individual channels 20 to each other is provided; and the resistance from the one end 25*a* up to the linking part 25*c* of the outflow channel 25 (the resistance in the part corresponding to the length A1) in the individual channel 20 located on the upstream side in the return channel 32 and the resistance from the one end 25*a* up to the linking part 25*c* of the outflow channel 25 (the resistance in the part corresponding to the length A2) in the individual channel 20 located on the downstream side in the return channel 32 are different from each other (see FIG. 2). In this case, in the case of circulating the ink, the difference in the pressure is generated at the both ends of the linking channel 26, which in turn generates the above-described flow of the ink. With this, it is possible to realize the discharge of the air in the inside of the linking channel 26 and/or the agitation of any sedimentary component in the inside of the linking channel 26.

Further, by linking the outflow channels 25 (of the two individual channels 20) to each other by the linking channel 26, it is possible to suppress such a situation that the pressure generated in the pressure chamber 22 in one of the two individual channels 20 is propagated directly to the return channel 32 via the outflow channel 25 (and further to suppress such a situation that the pressure propagates, via the return channel 32, to another individual channel 20 (such as the other of the two individual channels 20) and to harmfully influence the discharge).

In the two individual channels 20, the resistance from the linking part 25*c* up to the other end 25*b* of the outflow channel 25 (the resistance in the part corresponding to the length A3) in the individual channel 20 located on the upstream side in the return channel 32 and the resistance from the linking part 25*c* up to the other end 25*b* of the outflow channel 25 (the resistance in the part corresponding to the length A4) in the individual channel 20 located on the downstream side in the return channel 32 are different from each other (see FIG. 2). In this case, also in the case of performing the purge, the above-described flow of the ink is generated in the inside of the linking channel 26, thereby making it possible to realize the discharge of the air in the inside of the linking channel 26 and/or the agitation of any sedimentary component in the inside of the linking channel 26.

The connecting channel 27 connecting the linking channel 26 to the return channel 32 (see FIG. 2) is further provided. In this case, the pressure is dispersed not only via the linking channel 26, but also via the connecting channel 27. With this, it is possible to suppress, in a more ensured manner, the problem of propagation of the pressure to another individual channel 20 and any harmful influence on the discharge caused thereby.

The direction from the one end 27*a* toward the other end 27*b* of the connecting channel 27 includes the component in the direction (vector) toward the downstream side in the return channel 32 (the lower side in FIG. 2). Namely, the direction from the one end 27*a* toward the other end 27*b* of the connecting channel 27 is not orthogonal to the direction toward the downstream side in the return channel 32 (the lower side in FIG. 2). Namely, in this case, the flow of the ink inside the connecting channel 27 does not hinder the flow of the ink inside the return channel 32, and allows the ink to flow smoothly in the connecting channel 27, the return channel 32 and further into the return port 32*x*, during the ink circulation.

The resistance in the connecting channel 27 is smaller than the resistance in the linking channel 26. In this case, the ink is allowed to flow smoothly in the inside of the connecting channel 27, which in turn enhances the effect of dispersing the pressure by the connecting channel 27.

In each of the two individual channels 20, the length A1, A2 from the one end 25*a* up to the linking part 25*c* of the outflow channel 25 is longer than the length A3, A4, from the linking part 25*c* up to the other end 25*b* of the outflow channel 25 (A1>A3, A2>A4). Namely, the linking channel 26 is located at a position relatively away from the pressure chamber 22. In a case that the linking channel 26 is located at a position close to the pressure chamber 22, the pressure propagated to the linking channel 26 propagates to the pressure chamber 22 and harmfully influences the discharge (of the ink). In contrast, in the present embodiment, the linking channel 26 is located away from the pressure chamber 22, and thus the above-described problem can be suppressed.

Among the two individual channels 20, the length A1 in the second direction from the one end 25*a* up to the linking part 25*c* of the outflow channel 25 in the individual channel 20 located on the upstream side in the return channel 32 (the upper side in FIG. 2) is shorter than the length A2 in the second direction from the one end 25*a* up to the linking part 25*c* of the outflow channel 25 in the individual channel 20 located on the downstream side in the return channel 32 (the lower side in FIG. 2) (A1<A2). Namely, in the individual channel 20 located on the upstream side in the return channel 32 (the upper side in FIG. 2), the linking part 25*c* is located at a position closer to the pressure chamber 22 than that in the individual channel 20 located on the downstream side in the return channel 32 (the lower side in FIG. 2). With this, the ink flows from the outflow channel 25 of the individual channel 20 located on the upstream side in the return channel 32 (the upper side in FIG. 2), passes the linking channel 26, and into the outflow channel 25 of the individual channel 20 located on the downstream side in the return channel 32 (the lower side in FIG. 2), along the flow in the return channel 32.

The linking channel 26 extends in the oblique direction (direction orthogonal to the vertical direction and crossing both of the first and second directions). In this case, the ink flows smoothly, as compared with another case, as in a second embodiment (FIG. 4; which will be described later on) wherein a linking channel 226 has points of inflection B1 and B2. Accordingly, it is possible to realize, in a further ensured manner, the discharge of the air inside the linking channel 26 and/or the agitation of any sedimentary component inside the linking channel 26.

Among the two outflow channels 25 which are linked to each other by the linking channel 26, the angle θ1 defined between the linking channel 26 and the outflow channel 25 included in the two outflow channels 25 and located on the upstream side in the return channel 32 (the upper side in FIG. 2) is less than 80 degrees. This configuration is effective in making the flow rate inside the linking channel 26 to the amount which is considered to be suitable for exhausting the air inside the linking channel 26 and/or agitating any sedimentary component inside the linking channel 26 (for example, not less than 75 nl/sec).

In the two individual channels 20, the difference between the resistance from the one end 25*a* up to the linking part 25*c* of the outflow channel 25 (the resistance in the part corresponding to the length A1) in the individual channel 20 located on the upstream side in the return channel 32 (the upper side in FIG. 2) and the resistance from the one end 25*a* up to the linking part 25*c* of the outflow channel 25 (the resistance in the part corresponding to the length A2) in the individual channel 20 located on the downstream side in the return channel 32 (the lower side in FIG. 2) can be made to be not less than 800 kPa/(cc/sec). In this case, it is possible to make the flow rate inside the linking channel 26 to be the above-described amount which is considered to be suitable (for example, not less than 75 nl/sec), thereby making it possible to realize the exhaust of the air in the inside of the linking channel 26 and/or the agitation of any sedimentary component in the inside of the linking channel 26, in a further ensured manner.

Second Embodiment

Figure 4:
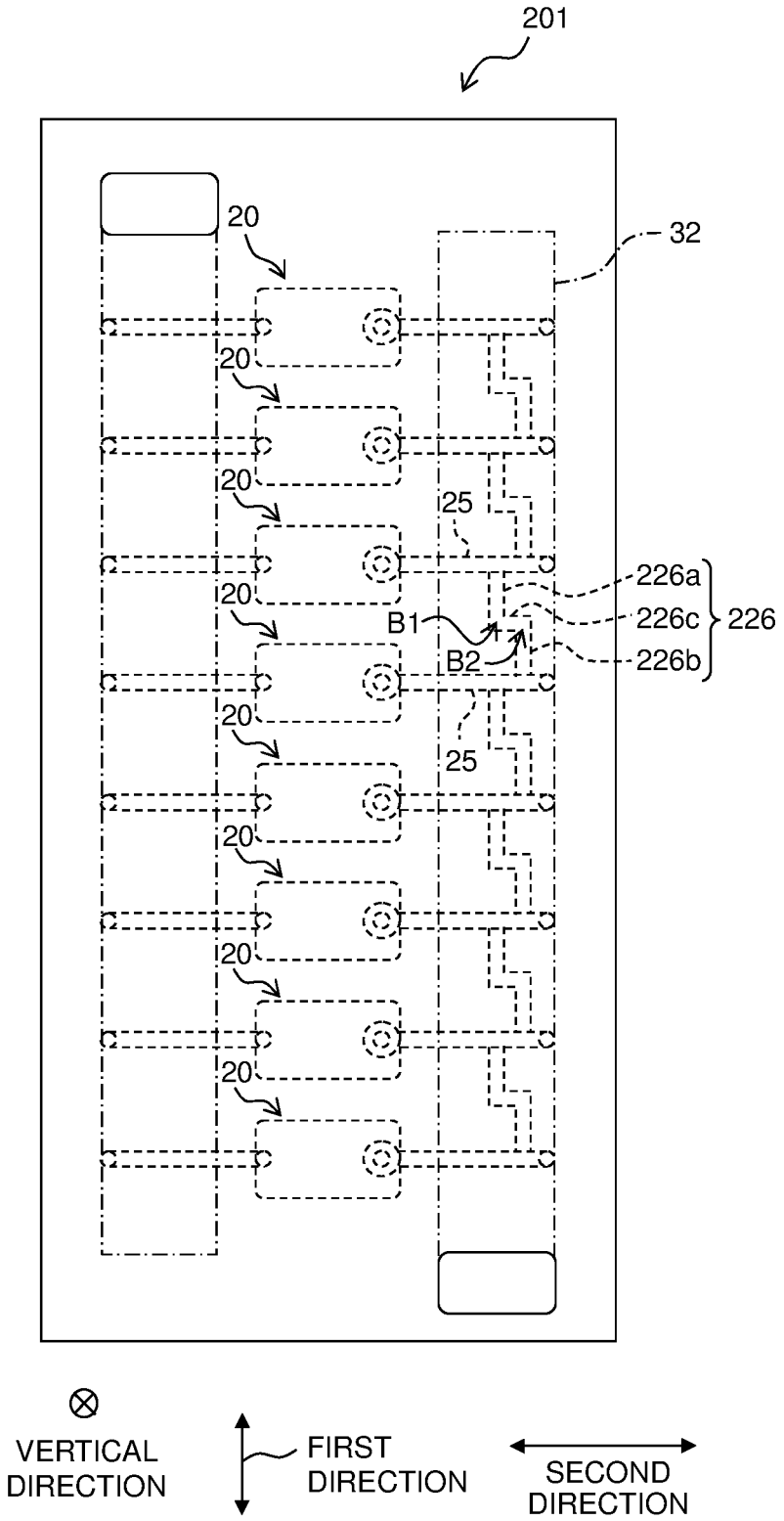
FIG. 4 is a plan view of a head 201.

Next, a head 201 according to a second embodiment of the present disclosure will be explained, with reference to FIG. 4.

In the first embodiment (FIG. 2), the linking channel 26 extends in the oblique direction. In the second embodiment (FIG. 4), however, a linking channel 226 has a bent or curved shape in a plane orthogonal to the vertical direction, and has two points of inflection B1 and B2. Specifically, the linking channel 226 has a first part 226*a* extending in the first direction from the outflow channel 25 of an individual channel 20 which is included in the two individual channels 20 and which is located on the upstream side in the return channel 32 (the upper side in FIG. 4); a second part 226*b* extending in the first direction from the outflow channel 25 of an individual channel 20 which is included in the two individual channels 20 and which is located on the downstream side in the return channel 32 (the lower side in FIG. 4); and a third part 226*c* connecting a forward end of the first part 226*a* and a forward end of the second part 226*b* and extending in the second direction. The point of inflection B1 is provided at the boundary between the first part 226*a* and the third part 226*c*, and the point of inflection B2 is provided at the boundary between the second part 226*b* and the third part 226*c*. Further, in the second embodiment, the connecting channel 27 (see FIG. 2) is not provided.

According to the second embodiment wherein although the configuration of the liking channel is different from that in the first embodiment, the second embodiment satisfies the requirement similar to that in the first embodiment, thereby achieving the effects similar to those in the first embodiment.

Further, in the second embodiment, owing to the configuration wherein the linking channel 226 has the two points of inflection B1 and B2, the channel resistance in the linking channel 226 is made to be great, thereby increasing the flow rate in the inside of the linking channel 226. With this, it is possible to realize the exhaust of the air in the inside of the linking channel 226 and/or the agitation of any sedimentary component in the inside of the linking channel 226, in a further ensured manner.

Third Embodiment

Next, a head 301 according to a third embodiment of the present disclosure will be explained, with reference to FIG. 5.

In the first embodiment (FIG. 2), the linking channel 26 linking the outflow channels 25 of the two individual channels 20 to each other is provided. In the third embodiment (FIG. 5), however, a linking channel 326 linking the inflow channels 24 of the two individual channels 20 to each other is provided, and the outflow channels 25 of the two individual channels 20 are not linked to each other. The third embodiment is further provided with a connecting channel 327 connecting the linking channel 326 to the supply channel 31.

In the third embodiment, the supply channel 31 corresponds to a "common channel" of the present disclosure, and the inflow channel 24 corresponds to a "communicating channel" of the present disclosure. The inflow channels 24 of the respective individual channels 20 have channel areas which are same as each other, and lengths in the second direction which are same as each other. Note that in the following explanation, the terms "upstream side" and "downstream side" indicate the "upstream side" and "downstream side" in the direction of flow of the ink during the ink circulation.

The linking channels 326 are provided in areas, respectively, which are located, in the first direction, between the inflow channels 24 of the plurality of individual channels 20. The connecting channels 327 are provided with respect to the linking channels 326, respectively. The linking channels 326 and the connecting channels 327 are provided at a same height as the inflow channel 24 (at a location above the supply channel 31).

Each of the linking channels 326 extends in an oblique direction (a direction which is orthogonal to the vertical direction, and which crosses both of the first and second directions). Specifically, each of the linking channels 326 extends so as to be closer to the pressure chamber 22 toward the downstream side (the lower side in FIG. 5) of the inflow channel 31. An angle θ3 defined between the linking channel 326 and an inflow channel 24 which is included in the two inflow channels 24, of the two individual channels 20, linked to each other by each of the linking channel 326, and which is located on the upstream side in the supply channel 31, is less than 80 degrees.

In the two individual channels 20, the positions of linking parts 24*c*, at which the inflow channels 24 in the two individual channels 20 are linked to the linking part 326, respectively, are mutually different in the second direction. Specifically, among the two individual channels 20, the linking part 24*c* in the individual channel 20 located on the upstream side in the supply channel 31 (the upper side in FIG. 5) is located farther away in the second direction from the pressure chamber 22 than the linking part 24*c* in the individual channel 20 located on the downstream side in the supply channel 31 (the lower side in FIG. 5).

Among the two individual channels 20, a length C1 in the second direction from the other end 24*b* up to the linking part 24*c* of the inflow channel 24 in the individual channel 20 located on the upstream side in the supply channel 31 (the upper side in FIG. 5) is shorter than a length C2 in the second direction from the other end 24*b* up to the linking part 24*c* of the inflow channel 24 in the individual channel 20 located on the downstream side (the lower side in FIG. 5) (C1<C2). Among the two individual channels 20, a length C3 in the second direction from the linking part 24*c* up to the one end 24*a* of the inflow channel 24 in the individual channel 20 located on the upstream side in the supply channel 31 (the upper side in FIG. 5) is longer than a length C4 in the second direction from the linking part 24*c* up to the one end 24*a* of the inflow channel 24 in the individual channel 20 located on the downstream side (the lower side in FIG. 5) (C3>C4).

In the two individual channels 20, owing to such a positional relationship regarding the linking parts 24*c*, the resistance from the other end 24*b* up to the linking part 24*c* of the inflow channel 24 (the resistance in a part corresponding to the length C1) in the individual channel 20 located on the upstream side in the supply channel 31 and the resistance from the other end 24*b* up to the linking part 24*c* of the inflow channel 24 (the resistance in a part corresponding to the length C2) in the individual channel 20 located on the downstream side in the supply channel 31 are different from each other. The resistance in the part corresponding to the length C1 is smaller than the resistance in the part corresponding to the length C2. This difference in the resistance can be made to be not less than 1300 kPa/(cc/sec). The difference in the resistance can be derived by setting an amount which is considered to be suitable for exhausting the air and/or agitating any sedimentary component (for example, 75 nl/sec), as a flow rate Q in the inside of the linking channel 326, from the relationship of pressure P/flow rate Q.

Further, in the two individual channels 20, the resistance from the linking part 24*c* up to the one end 24*a* of the inflow channel 24 (the resistance in a part corresponding to the length C3) in the individual channel 20 located on the upstream side in the supply channel 31 and the resistance from the linking part 24*c* up to the one end 24*a* of the inflow channel 24 (the resistance in a part corresponding to the length C4) in the individual channel 20 located on the downstream side in the supply channel 31 are different from each other. The resistance in the part corresponding to the length C3 is greater than the resistance in the part corresponding to the length C4 (C3>C4).

The linking channel 326 links to a part, in each of the inflow channels 24, which is located between the center in the second direction and the other end 24*b* in the second direction. In each of the two individual channels 20, the length C3, C4 from the one end 24*a* up to the linking part 24*c* of the inflow channel 24 is greater than the length C1, C2 from the linking part 24*c* up to the other end 24*b* of the inflow channel 24 (C3>C1, C4>C2).

For example, it is allowable that C1=200 μm, C2=300 μm, C3=500 μm, and C4=400 μm.

The connecting channel 327 has one end 327*a* at which the connecting channel 327 connects to the supply channel 31, and the other end 327*b* at which the connecting channel 327 connects to the linking channel 326. The connecting channel 327 extends in the oblique direction (direction orthogonal to the vertical direction and crossing both of the first and second directions). An extending direction of the connecting channel 327 crosses the extending direction of the linking channel 326. A direction from the one end 327*a* toward the other end 327*b* of the connecting channel 327 includes a component of a direction (vector) toward the downstream side in the supply channel 31 (the lower side in FIG. 5), and a component of a direction (vector) from the supply channel 31 toward the pressure chamber 22 (the right side in FIG. 5). Namely, the direction from the one end 327*a* toward the other end 327*b* of the connecting channel 327 is not orthogonal to the direction toward the downstream side in the return channel 31 (the lower side in FIG. 5), and is not orthogonal to the direction toward the supply channel 31 toward the pressure chamber 22 (the right side in FIG. 5).

The connecting channel 327 has a length (channel length) smaller than that of the linking channel 326, and a resistance smaller than that in the linking channel 326.

In the following, an explanation will be given about a flow of the ink in a case of circulating the ink and in a case of performing the purge.

Figure 5:
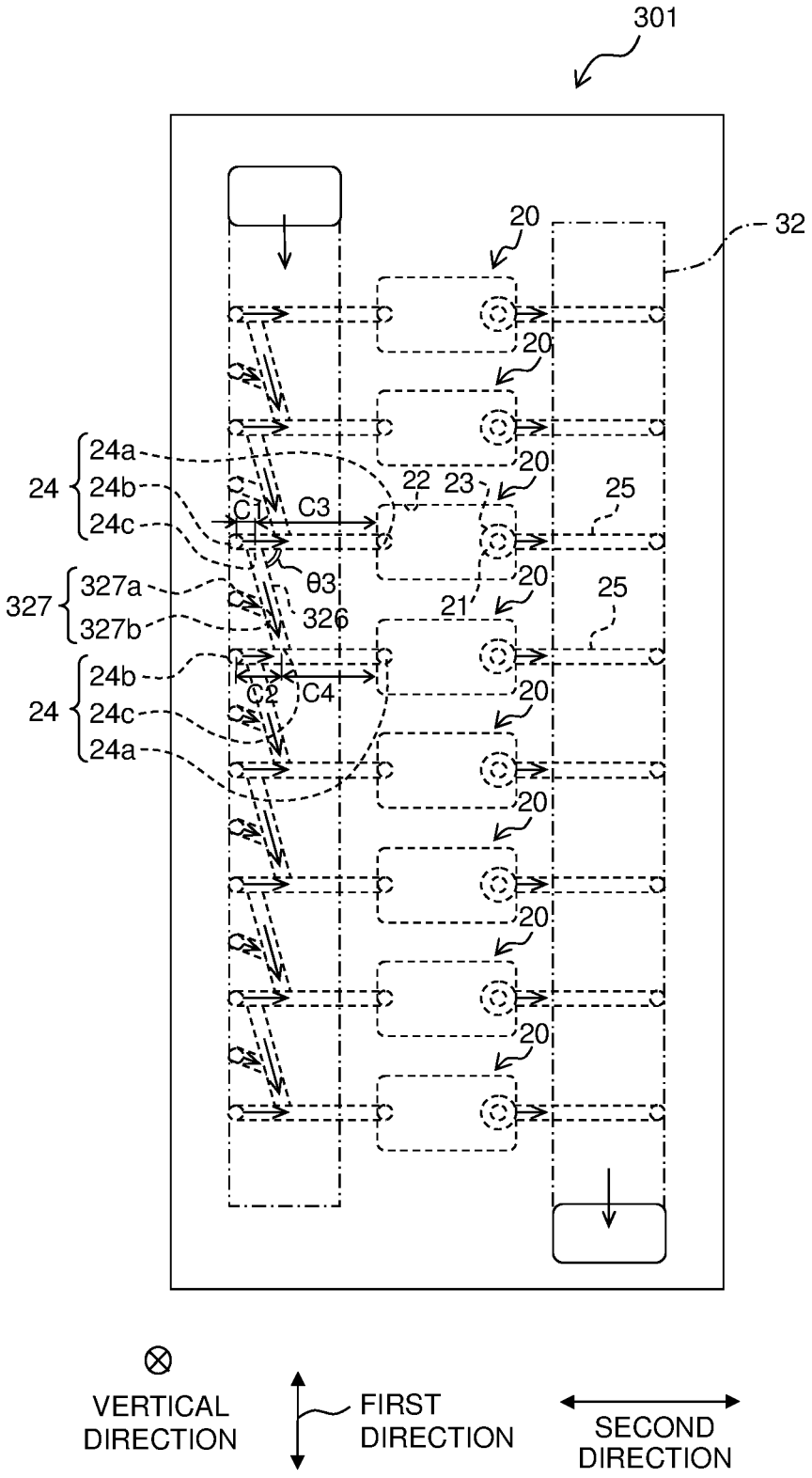
FIG. 5 is a plan view of a head 301.

In the case of circulating the ink, the ink inflowed into the supply channel 31 inflows into each of the other end 24*b* of the inflow channel 24 and the one end 327*a* of the connecting channel 327 of each of the plurality of individual channels 20, while moving in the inside of the supply channel 31 from the one end in the first direction (upper end in FIG. 5) toward the other end in the first direction (lower end in FIG. 5).

Among the two individual channels 20, in the individual channel 20 located on the upstream side in the supply channel 31 (the upper side in FIG. 5), a part of the ink inflowed into the other end 24*b* of the inflow channel 24 inflows into the linking channel 326 from the linking part 24*c*, and the remainder of the ink arrives at the one end 24*a* and inflows into the pressure chamber 22. The ink inflowed into the linking channel 326 flows in the inside of the linking channel 326 in the oblique direction toward the downstream side in the supply channel 31 (the lower side in FIG. 5).

The ink inflowed into the one end 327*a* of the connecting channel 327 flows in the inside of the connecting channel 327 in the oblique direction toward the downstream side in the supply channel 31 (the lower side in FIG. 5), and inflows into the linking channel 326. This ink joins with the ink inflowed into the linking channel 326 from the inflow channel 24 of the individual channel 20 among the two individual channel 20 and located on the upstream side in the supply channel 31 (the upper side in FIG. 5), and inflows into the inflow channel 24 of the individual channel 20 among the two individual channel 20 and located on the downstream side in the supply channel 31 (the lower side in FIG. 5).

In the individual channel 20 among the two individual channel 20 and located on the downstream side in the supply channel 31 (the lower side in FIG. 5), the ink inflowed into the other end 24*b* of the inflow channel 24 flows from the other end 24*b* toward the one end 24*a*, joins with the ink inflowed from the linking part 24*c*, reaches the one end 24*a*, and inflows into the pressure chamber 22.

The ink inflowed into the pressure chamber 22 moves substantially horizontally in the inside of the pressure chamber 22, and then inflows into the connecting channel 23. The ink inflowed into the connecting channel 23 moves downward; a part or portion of the ink is discharged from the nozzle 21, and the remaining part of the ink inflows into the outflow channel 25. The ink inflowed into the outflow channel 25 moves substantially horizontally in the inside of the outflow channel 25, and then inflows into the return channel 32.

In the case of performing the purge, the ink inflowed into the supply channel 31 inflows into each of the other end 24*b* of the inflow channel 24 of one of the plurality of individual channel 20 and the one end 327*a* of the connecting channel 327, while flowing in the inside of the supply channel 31 from the one end in the first direction (upper end in FIG. 5) toward the other end in the first direction (lower end in FIG. 5), in a similar manner as that in the case of circulating the ink. The ink inflows in the pressure chamber 22 via a route similar to that in the case of circulating the ink, moves substantially horizontally in the inside of the pressure chamber 22, and then inflows into the connecting channel 23. The ink inflowed into the connecting channel 23 moves downward; all of the ink is discharged from the nozzle 21, without flowing into the outflow channel 25.

In the case of performing the purge, the ink inflowed into the return channel 32 moves from the other end (lower end in FIG. 5) toward the one end (upper end in FIG. 5) in the first direction in the inside of the return channel 32, in a reverse manner of that in the case of circulating the ink. This ink inflows into the outflow channel 25, further inflows into the connecting channel 23, and is discharged from the nozzle 21 of each of the plurality of individual channels 20.

As described above, according to the third embodiment, the linking part 326 linking the inflow channels 24 of the two individual channels 20 to each other is provided; and the resistance from the other end 24*b* up to the linking part 24*c* of the inflow channel 24 (the resistance in the part corresponding to the length C1) in the individual channel 20 located on the upstream side in the supply channel 31 and the resistance from the other end 24*b* up to the linking part 24*c* of the inflow channel 24 (the resistance in the part corresponding to the length C2) in the individual channel 20 located on the downstream side in the supply channel 31 are different from each other (see FIG. 5). In this case, in the case of circulating the ink and in the case of the purge, the difference in the pressure is generated at the both ends of the linking channel 326, which in turn generates the above-described flow of the ink. With this, it is possible to realize the discharge of the air in the inside of the linking channel 326 and/or the agitation of any sedimentary component in the inside of the linking channel 326.

Further, by linking the inflow channels 24 (of the two individual channels 20) to each other by the linking channel 326, it is possible to suppress such a situation that the pressure generated in the pressure chamber 22 in one of the two individual channels 20 is propagated directly to the supply channel 31 via the inflow channel 24 (and further to suppress such a situation that the pressure propagates, via the supply channel 31, to another individual channel 20 (such as the other of the two individual channels 20) and to harmfully influence the discharge).

The connecting channel 327 connecting the linking channel 326 and the supply channel 31 to each other is further provided (see FIG. 5). In this case, the pressure is dispersed not only via the linking channel 326, but also via the connecting channel 327. With this, it is possible to suppress such a problem that the pressure generated in the pressure chamber 22 in one of the two individual channels 20 is propagated to another individual channel 20 (such as the other of the two individual channels 20) and to harmfully influence the discharge.

The direction from the one end 327*a* toward the other end 327*b* of the connecting channel 327 includes the vector (a component in a direction) toward the downstream side in the supply channel 31 (the lower side in FIG. 5). In this case, the flow of the ink inside the connecting channel 327 during the ink circulation and during the purge does not hinder the flow of the ink inside the supply channel 31, and allows the ink to flow smoothly from the connecting channel 327 into the supply channel 31.

The resistance in the connecting channel 327 is smaller than the resistance in the linking channel 326. In this case, the ink is allowed to flow smoothly in the inside of the connecting channel 327, which in turn enhances the effect of dispersing the pressure by the connecting channel 327.

In each of the two individual channels 20, the length C3, C4 from the linking part 24*c* up to the one end 24*a* of the inflow channel 24 is longer than the length C1, C2 from the other end 24*b* up to the linking part 24*c* of the inflow channel 24 (C3>C1, C4>C2). Namely, the linking channel 326 is located at a position relatively away from the pressure chamber 22. In a case that the linking channel 326 is located at a position close to the pressure chamber 22, the pressure propagated to the linking channel 326 propagates to the pressure chamber 22 and harmfully influences the discharge (of the ink). In contrast, in the third embodiment, the linking channel 326 is located away from the pressure chamber 22, and thus the above-described problem can be suppressed.

Among the two individual channels 20, the length C1 in the second direction from the other end 24*b* up to the linking part 24*c* of the inflow channel 24 in the individual channel 20 located on the upstream side in the supply channel 31 (the upper side in FIG. 5) is shorter than the length C2 in the second direction from the other end 24*b* up to the linking part 24*c* of the inflow channel 24 in the individual channel 20 located on the downstream side in the supply channel 31 (the lower side in FIG. 5) (C1<C2). Namely, in the individual channel 20 located on the downstream side in the supply channel 31 (the lower side in FIG. 5), the linking part 24*c* is located at a position closer to the pressure chamber 22 than that in the individual channel 20 located on the upstream side in the supply channel 31 (the upper side in FIG. 5). With this, the ink flows from the inflow channel 24 of the individual channel 20 located on the upstream side in the supply channel 31 (the upper side in FIG. 5), passes the linking channel 326, and into the inflow channel 24 of the individual channel 20 located on the downstream side in the supply channel 31 (the lower side in FIG. 5), along the flow in the supply channel 31.

The linking channel 326 extends in the oblique direction (direction orthogonal to the vertical direction and crossing both of the first and second directions). In this case, the ink flows smoothly, as compared with another case, as in a fourth embodiment (FIG. 6; which will be described later on) wherein a linking channel 426 has points of inflection D1 and D2. Accordingly, it is possible to realize, in a further ensured manner, the discharge of the air inside the linking channel 326 and/or the agitation of any sedimentary component inside the linking channel 326.

Among the two inflow channels 24 which are linked to each other by the linking channel 326, the angle θ3 defined between the linking channel 326 and the inflow channel 24 included in the two inflow channels 24 and located on the upstream side in the supply channel 31 (the upper side in FIG. 5) is less than 80 degrees. This configuration is effective in making the flow rate inside the linking channel 326 to be the amount which is considered to be suitable for exhausting the air inside the linking channel 326 and/or agitating any sedimentary component inside the linking channel 326 (for example, not less than 75 nl/sec).

In the two individual channels 20, the difference between the resistance from the other end 24*b* up to the linking part 24*c* of the inflow channel 24 (the resistance in the part corresponding to the length C1) in the individual channel 20 located on the upstream side in the supply channel 31 (the upper side in FIG. 5) and the resistance from the other end 24*b* up to the linking part 24*c* of the inflow channel 24 (the resistance in the part corresponding to the length C2) in the individual channel 20 located on the downstream side in the supply channel 31 (the lower side in FIG. 5) can be made to be not less than 1300 kPa/(cc/sec). In this case, it is possible to realize the exhaust of the air in the inside of the linking channel 326 and/or the agitation of any sedimentary component in the inside of the linking channel 326, in a further ensured manner.

Fourth Embodiment

Figure 6:
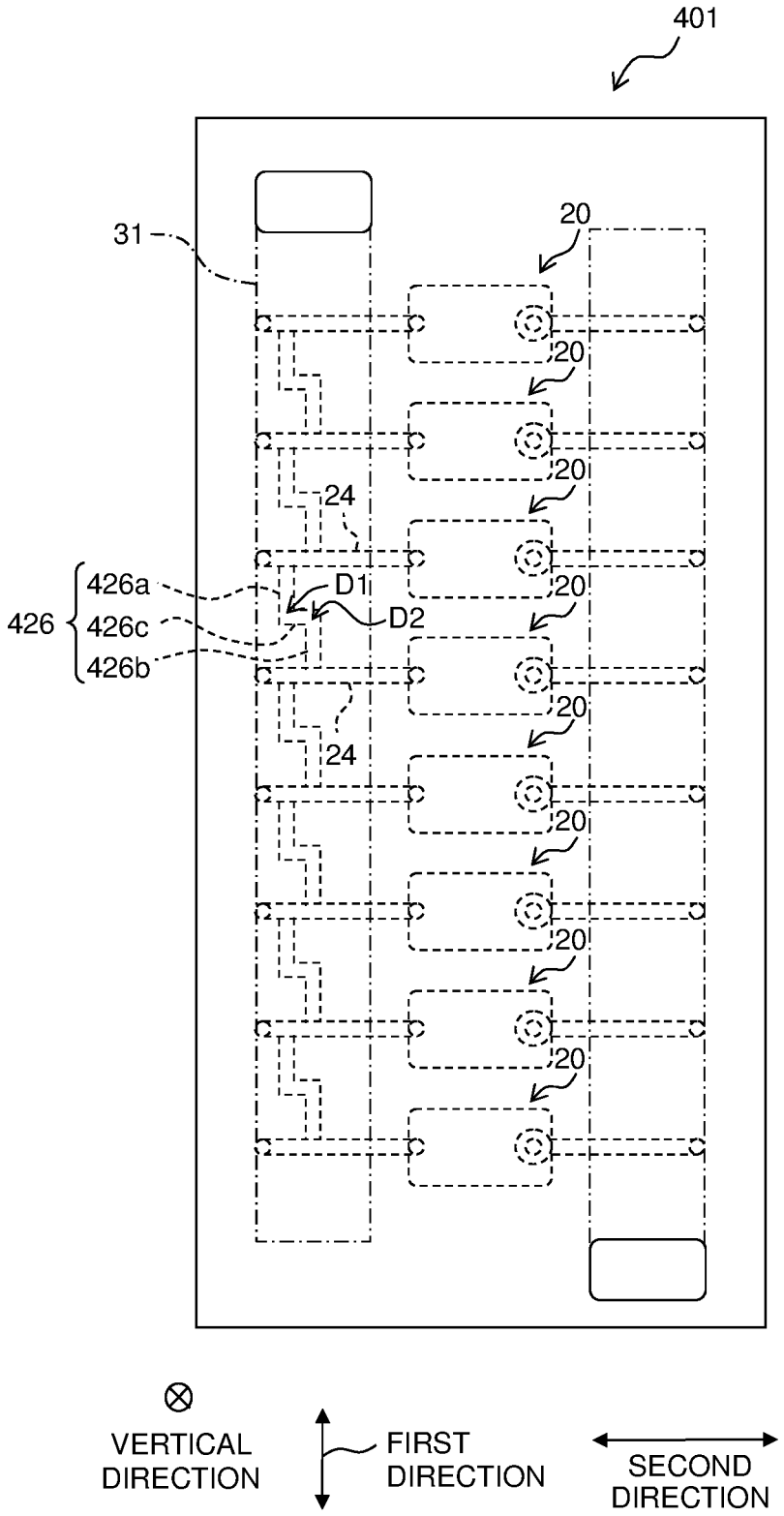
FIG. 6 is a plan view of a head 401.

Next, a head 401 according to a fourth embodiment of the present disclosure will be explained, with reference to FIG. 6.

In the third embodiment (FIG. 5), the linking channel 326 extends in the oblique direction. In the fourth embodiment (FIG. 6), however, a linking channel 426 has a bent or curved shape in a plane orthogonal to the vertical direction, and has two points of inflection D1 and D2. Specifically, the linking channel 426 has a first part 426*a* extending in the first direction from the inflow channel 24 of an individual channel 20 which is included in the two individual channels 20 and which is located on the upstream side in the supply channel 31 (the upper side in FIG. 6); a second part 426*b* extending in the first direction from the inflow channel 24 of an individual channel 20 which is included in the two individual channels 20 and which is located on the downstream side in the supply channel 31 (the lower side in FIG. 6); and a third part 426*c* connecting a forward end of the first part 426*a* and a forward end of the second part 426*b* and extending in the second direction. The point of inflection D1 is provided at the boundary between the first part 426*a* and the third part 426*c*, and the point of inflection D2 is provided at the boundary between the second part 426*b* and the third part 426*c*. Further, in the fourth embodiment, the connecting channel 327 (see FIG. 5) is not provided.

According to the fourth embodiment wherein although the configuration of the liking channel is different from that in the third embodiment, the fourth embodiment satisfies the requirement similar to that in the third embodiment, thereby achieving the effects similar to those in the third embodiment.

Further, in the fourth embodiment, owing to the configuration wherein the linking channel 426 has the two points of inflection D1 and D2, the channel resistance in the linking channel 426 is made to be great, thereby increasing the flow rate in the inside of the linking channel 426. With this, it is possible to realize the exhaust of the air in the inside of the linking channel 426 and/or the agitation of any sedimentary component in the inside of the linking channel 426, in a further ensured manner.

Modifications

In the foregoing, the embodiments of the present disclosure have been explained. The present disclosure, however, is not limited to or restricted by the above-described embodiments; it is allowable to make a various kind of design changes to the present disclosure, within the scope described in the claims.

In each of the above-described embodiments, either one of the linking channel linking the outflow channels to each other and the linking channel linking the inflow channels to each other is provided. It is allowable, however, that both of the linking channel linking the outflow channels to each other and the linking channel linking the inflow channels to each other are provided.

In the configuration provided with the linking channel linking the inflow channels to each other (the third and fourth embodiments), it is allowable to omit the outflow channels and the return channel.

In the respective embodiments described above, the positions of the linking parts in the two individual channels, respectively, are made to be different from each other to thereby make the resistances, each from the one end up to the linking part of the outflow channel, in the two individual channels, respectively, to be different from each other (the first and second embodiments), or to thereby make the resistances, each from the other end up to the linking part of the inflow channel, in the two individual channels, respectively, to be different from each other (the third and fourth embodiments). The present disclosure, however, is not limited to or restricted by this configuration. For example, it is allowable to make the above-described resistances in the two individual channels, respectively, to be different from each other due to, for example, any difference in the channel area between the two individual channels.

In the two individual channels 20 of the first embodiment, the resistance from the linking part 25*c* up to the other end 25*b* of the outflow channel (the resistance corresponding to the length A3) and the resistance from the linking part 25*c* up to the other end 25*b* of the outflow channel (the resistance corresponding to the length A3) may be same as each other.

In the above-described embodiments, the linking channel is provided with respect each of the areas between the outflow channels or between the inflow channels in the first direction. The present disclosure, however, is not limited to this configuration. For example, the linking channels may be provided with respect to every other outflow or inflow channels, with respect to every third inflow or outflow channels, or in a random pattern, in the first direction.

In the first and third embodiments, although the linking channel extends in the oblique direction, the linking channel may extend in the first direction.

In the second and fourth embodiments, although the linking channel has the two points of inflection, it is allowable that the linking channel has three or more pieces of the point of inflection.

In the first and third embodiments, the connecting channel may extend in the second direction. Further, the resistance in the connecting channel may be same as, or greater than, the resistance in the linking channel. In the first and third embodiments, the connecting channel may be omitted.

In the above-described embodiments, the inflow channel and the outflow channel overlap with the common channels, respectively, in the direction (vertical direction) which is orthogonal to both of the first and second direction. The present disclosure, however, is not limited to this. For example, it is allowable that the inflow channel and the outflow channel do not overlap with the common channels, respectively, in the vertical direction, and that the inflow channel and the outflow channel are arranged side by side with respect to the common channels, respectively, in the second direction.

In the above-described embodiments, the outflow channel communicates the pressure chamber with the return channel (second common channel) via the connecting flow channel. The present disclosure, however, is not limited to this configuration. It is allowable that the outflow channel communicates directly with the pressure chamber, not via the connecting flow channel, so as to communicate the pressure chamber with the return channel.

In the above-described embodiments, the plurality of individual channels are aligned in a row in the first direction. The present disclosure, however, is not limited to this configuration. For example, the plurality of individual channels may be aligned in a plurality of rows in the first direction, or the plurality of individual channels may be aligned in a staggered manner.

In the above-described embodiments, although the number of the nozzle belonging to each of the individual channels is 1 (one), it is allowable that the number of nozzle belonging to each of the individual channels may be not less than 2 (two).

The liquid discharge head is not limited to being the head of the line system; it is allowable that the liquid discharge head is a head of a serial system (a system in which the head discharges a liquid from a nozzle toward an object or target of discharge, while the head moves in a scanning direction parallel to the paper width direction).

The object of discharge is not limited to being a paper sheet (sheet, paper); the object of discharge may be, for example, cloth (fabric), substrate, etc.

The liquid discharged (dischargeable) from the nozzle is not limited to being the ink; it is allowable that the liquid is any liquid (for example, a treating liquid causing a component in the ink to aggregate or deposit; etc.).

The present disclosure is not limited to being applicable to the printer; the present disclosure is applicable also to a facsimile machine, copying machine, a multifunction peripheral, etc. Further, the present disclosure is also applicable to a liquid discharge apparatus usable for a usage different from recording of an image (for example, a liquid discharge apparatus configured to discharge a conductive liquid onto a substrate so as to form a conductive pattern), etc.

What is claimed is:

1. A liquid discharge head comprising:

a channel unit including:

a first common channel extending in a first direction;

a second common channel extending in the first direction;

a plurality of individual channels aligned in the first direction, each of the plurality of individual channels including:

a nozzle;

a pressure chamber communicating with the nozzle;

a first communicating channel having one end communicating with the pressure chamber and another end communicating with the first common channel; and a second communicating channel having one end communicating with the pressure chamber and another end communicating with the second common channel; and a linking channel linking two pieces of the second communicating channel to each other, the two pieces of the second communicating channel being included in two individual channels among the plurality of individual channels, wherein resistance, in one of the two individual channels, from the one end of the second communicating channel up to a linking part of the second communicating channel at which the second communicating channel is linked to the linking channel is different from resistance, in the other of the two individual channels, from the one end of the second communication channel up to the linking part of the second communicating channel.

2. The liquid discharge head according to claim 1, wherein resistance, in the one of the two individual channels, from the linking part up to the other end of the second communicating channel is different from resistance, in the other of the two individual channels, from the linking part up to the other end of the second communicating channel.

3. The liquid discharge head according to claim 1, wherein the channel unit further includes a connecting channel connecting the linking channel and the second common channel to each other.

4. The liquid discharge head according to claim 3, wherein a direction from one end, in the connecting channel, at which the connecting channel is connected to the linking channel toward another end, in the connecting channel, at which the connecting channel is connected to the second common channel includes a component in a direction toward a downstream side in the second common channel.

5. The liquid discharge head according to claim 3, wherein resistance in the connecting channel is smaller than resistance in the linking channel.

6. The liquid discharge head according to claim 1, wherein in each of the two individual channels, a length from the one end of the second communicating channel up to the linking part of the second communicating channel is longer than a length from the linking part up to the other end of the second communicating channel.

7. The liquid discharge head according to claim 1, wherein a length from the one end up to the linking part of the second communicating channel in an individual channel which is included in the two individual channels and which is located on an upstream side in the second common channel is shorter than a length from the one end of the second communicating channel up to the linking part of the second communicating channel in an individual channel which is included in the two individual channels and which is located on a downstream side in the second common channel.

8. The liquid discharge head according to claim 7, wherein the second communicating channel extends in a second direction crossing the first direction; and the linking channel extends in an oblique direction crossing both of the first direction and the second direction.

9. The liquid discharge head according to claim 8, wherein in the individual channel which is included in the two individual channels and which is located on the upstream side in the second common channel, an angle defined between the linking channel and the second communicating channel is less than 80 degrees.

10. The liquid discharge head according to claim 8, wherein a difference between the resistance, in the individual channel which is included in the two individual channels and which is located on the upstream side in the second common channel, from the one end up to the linking part of the second communicating channel and the resistance, in the individual channel which is included in the two individual channels and which is located on the downstream side in the second common channel, from the one end of the second communicating channel up to the linking part of the second communicating channel is not less than 800 kPa/(cc/sec).

11. The liquid discharge head according to claim 1, wherein the linking channel includes two or more points of inflection.

* * * * *